US010197223B2

(12) United States Patent
Weng et al.

(10) Patent No.: US 10,197,223 B2
(45) Date of Patent: Feb. 5, 2019

(54) SEMICONDUCTOR LAMP

(71) Applicant: OSRAM GmbH, Munich (DE)

(72) Inventors: Thomas Weng, Regensburg (DE); Stefan Ringler, Schwabmuhlhausen (DE); Thomas Klafta, Burglengenfeld (DE); Marianne Auernhammer, Monheim (DE)

(73) Assignee: LEDVANCE GMBH, Garching Bei, Munich (DE)

( * ) Notice: Subject to any disclaimer, the term of this patent is extended or adjusted under 35 U.S.C. 154(b) by 0 days.

(21) Appl. No.: 15/324,155

(22) PCT Filed: Apr. 29, 2015

(86) PCT No.: PCT/EP2015/059410

§ 371 (c)(1),
(2) Date: Jan. 5, 2017

(87) PCT Pub. No.: WO2016/005069

PCT Pub. Date: Jan. 14, 2016

(65) Prior Publication Data

US 2017/0146199 A1 May 25, 2017

(30) Foreign Application Priority Data

Jul. 9, 2014 (DE) ..... 10 2014 213 388

(51) Int. Cl.

| | |
|---|---|
| ***F21S 4/00*** | (2016.01) |
| ***F21K 9/237*** | (2016.01) |
| ***F21V 23/00*** | (2015.01) |
| ***F21V 29/508*** | (2015.01) |
| ***F21V 29/87*** | (2015.01) |

(Continued)

(52) U.S. Cl.

CPC ..... *F21K 9/237* (2016.08); *F21K 9/232* (2016.08); *F21K 9/233* (2016.08); *F21K 9/238* (2016.08); *F21K 9/69* (2016.08); *F21V 5/004* (2013.01); *F21V 5/04* (2013.01); *F21V 17/10* (2013.01); *F21V 17/101* (2013.01);

(Continued)

(58) Field of Classification Search

CPC ..... F21K 9/237; F21K 9/238; F21V 29/70; F21V 23/005

See application file for complete search history.

(56) References Cited

U.S. PATENT DOCUMENTS

2009/0161356 A1* 6/2009 Negley ..... H05B 33/0803 362/231
2009/0268470 A1 10/2009 Okimura et al.

(Continued)

FOREIGN PATENT DOCUMENTS

DE 102010001047 A1 7/2011
DE 102012205072 A1 10/2013

(Continued)

*Primary Examiner* — Evan Dzierzynski
(74) *Attorney, Agent, or Firm* — Hayes Soloway PC

(57) ABSTRACT

A semiconductor lamp (1) has at least one semiconductor light source (8) arranged on a front face (7) of a substrate (6) and a driver circuit (11) for activating the at least one semiconductor light source (8), at least part of the driver circuit (11) being secured on a rear face (10) of the substrate (6), facing away from the at least one semiconductor light source (8). The invention can be used, in particular, for retrofit lamps, in particular incandescent- or halogen retrofit lamps.

20 Claims, 4 Drawing Sheets

(51) Int. Cl.

| | |
|---|---|
| ***F21K 9/238*** | (2016.01) |
| ***F21V 29/70*** | (2015.01) |
| ***F21K 9/232*** | (2016.01) |
| ***F21V 5/00*** | (2018.01) |
| ***F21V 5/04*** | (2006.01) |
| ***F21V 17/10*** | (2006.01) |
| ***F21V 23/06*** | (2006.01) |
| ***F21K 9/233*** | (2016.01) |
| ***F21K 9/69*** | (2016.01) |
| *F21V 29/83* | (2015.01) |
| *F21Y 115/10* | (2016.01) |

(52) U.S. Cl.

CPC ..... *F21V 23/005* (2013.01); *F21V 23/06* (2013.01); *F21V 29/508* (2015.01); *F21V 29/70* (2015.01); *F21V 29/87* (2015.01); *F21V 29/83* (2015.01); *F21Y 2115/10* (2016.08)

(56) References Cited

U.S. PATENT DOCUMENTS

2011/0101861 A1 5/2011 Yoo
2011/0180819 A1* 7/2011 Van Elmpt ..... F21K 9/00 257/88
2011/0211351 A1 9/2011 Van De Ven et al.
2012/0320602 A1* 12/2012 Riesebosch ..... G02B 19/0028 362/297
2014/0153223 A1* 6/2014 Lin ..... G02F 1/133603 362/97.3

FOREIGN PATENT DOCUMENTS

DE 202013007007592 U1 10/2013
WO 2010032169 A1 3/2010
WO 2010032181 A1 3/2010

* cited by examiner

SEMICONDUCTOR LAMP

The invention concerns a semiconductor lamp having at least one semiconductor light source arranged on one side of a substrate, and a driver circuit for controlling the at least one semiconductor light source. The invention is particularly applicable to retrofit lamps, in particular incandescent or halogen retrofit lamps.

Retrofit lamps are known in which a driver board is accommodated in a driver cavity of a housing open at the front. The front side is closed by means of a metallic cover serving as a cooling body. A carrier (LED carrier) fitted with light-emitting diodes (LEDs) is arranged on an outside of the cooling body. The driver board and the LED carrier are therefore configured as two separate components which are connected together electrically by means of various forms of contact (plug, solder, wire etc.) through the cooling body. For present connection methods, there are scarcely any simple or economic methods for mechanical passage of the electrical connecting lines through the cooling body. This production step is rather usually performed manually.

A further disadvantage is that the heat transport from the LEDs to the cooling body through the carrier in between is not effective. In order to improve the heat transport, in some cases metal core plates are used as LED carriers, which are however expensive. Alternatively, also thin (e.g. 0.5 mm thick) FR4 plates may be used which also lead to increased costs and only slightly reduce a heat resistance of the LEDs to the cooling body.

It is the object of the present invention to overcome at least some of the disadvantages of the prior art. In particular, one object is to create a possibility for simplified electrical contacting of a driver circuit with associated semiconductor light sources, in particular LEDs, of a semiconductor lamp. A further particular object is to create a possibility for economic heat dissipation from semiconductor light sources, in particular LEDs, of a semiconductor lamp in a structurally simple and economic fashion.

This object is achieved according to the features of the independent claims. Preferred embodiments are described in particular in the dependent claims.

The object is achieved by a semiconductor lamp having at least one semiconductor light source arranged on a first side (referred to below, without restriction of generality, as the "front") of the substrate, and a driver circuit for controlling the at least one semiconductor light source, wherein at least part of the driver circuit is attached to a second side (referred to below, without restriction of generality, as the "back") of the substrate facing away from the at least one semiconductor light source.

Because the driver circuit is no longer attached to a circuit board separate from the substrate of the semiconductor light sources, there is no need for an electrical connection of two carriers, which substantially facilitates production. Also, in this way a reduction in components for contacting (plug, wire etc.) and hence a saving in component costs can be achieved. Also, one carrier may be omitted. The production process (e.g. a combination of wave soldering and SMD soldering) for such an equipped substrate is comparable to production processes for all common two-sided boards, and therefore known, available and economic. This again allows a saving of investment costs in special machines for e.g. laser soldering, and/or a saving of manual workstations. In addition, previously contacting of the driver board and LED carrier was often a mechanical weak point in the production technology, and hence frequently a problem for achieving quality control and a long service life. Since this contacting is no longer required in the present invention, the quality and service life can be increased and the risk of failure minimised.

The driver circuit may comprise several electrical and/or electronic components in order to convert electrical signals fed into the socket into electrical signals suitable for operation of the at least one semiconductor light source. It is not necessary for all components of the driver circuit to be present on the back, but some of the components may also be present on the front, in particular small and/or flat components such as resistors, e.g. thick layer resistors. Large components such as integrated circuits, capacitors, coils, electronic switches etc. are preferably attached only to the back of the substrate.

However, for a lightly laid and flat embodiment of the front, a configuration is advantageous in which all components of the driver circuit are present on the back.

In particular, the at least one semiconductor light source comprises at least one light-emitting diode (LED). In the presence of several LEDs, these may illuminate in the same colour or in different colours. One colour may be monochromatic (e.g. red, green, blue etc.) or polychromatic (e.g. white). Also, the light emitted by the at least one LED may be an infrared light (IR LED) or an ultraviolet light (UV LED). Several LEDs may generate a mixed light, e.g. a white mixed light. The at least one LED may contain at least one wavelength-converting phosphor (conversion LED). The phosphor may alternatively or additionally be arranged separately from the LED (remote phosphor). The at least one LED may be present in the form of an individual encapsulated LED, or in the form of at least one LED chip. Several LED chips may be mounted on the same substrate (submount). The at least one LED may be equipped with at least one specific and/or common lens for guiding the beam, e.g. at least one Fresnel lens, collimator, etc. Instead of or in addition to inorganic LEDs, e.g. based on InGaN or AlInGaP, in general also organic LEDs (OLEDs, e.g. polymer OLEDs) may be used. Alternatively, the at least one semiconductor light source may e.g. comprise at least one diode laser.

The semiconductor lamp comprises, in particular on its rear end, a socket for mechanical and electrical connection to a bulb fitting. The socket may for example be an Edison socket or a bi-pin socket. In particular, the back of the substrate may point in the direction of the socket (pointing to the rear) and the front may be facing away from the socket (pointing to the front).

In general, the terms "back" or "to the rear" mean a direction or orientation towards the socket. The terms "front" or "forward" may accordingly mean a direction or orientation away from the socket. Also the terms "front" or "forward" may mean a direction or orientation towards a light emission region. It is a refinement that the semiconductor lamp has a longitudinal axis which runs from a rear socket region to a front light emission region. Then the term "front" or "forward" may mean an arrangement or orientation in the direction of the longitudinal axis, and the terms "back" or "to the rear" may mean an arrangement or orientation opposite the direction of the longitudinal axis.

The substrate may comprise any suitable, electrically isolating base material, e.g. conventional base material for boards such as FR4, other plastics or ceramics. Also, a metal core board may be used. The substrate may on its front and/or its back have a conductive structure (e.g. comprising at least one conductor track and/or at least one contact field). Alternatively or additionally, components attached to the substrate may be electrically connected by means of a bonding wire or similar. However, other connection methods may also be used.

In one embodiment, a cooling body or a heat sink lies superficially on the front of the substrate. This is now possible since the cooling body need no longer be provided as a partition between the driver board and the LED carrier. This embodiment gives the advantage that, on the side on which the semiconductor light sources are present, the substrate is cooled by the cooling body, a heat resistance through the substrate is eliminated, and the cooling body is thermally connected particularly effectively to the semiconductor light sources. The improved cooling connection also allows a reduction in material (e.g. aluminium) in the lamp, and thus optimises costs. The improved cooling connection may also extend the life, allow a use of cheaper components, and/or facilitate an omission of a potting compound (see below). However, in particular with only a low power level of the at least one semiconductor light source, the cooling body may also be omitted.

The cooling body may consist for example of ceramic or metal, e.g. aluminium.

In one embodiment, the cooling body has at least one recess for the at least one semiconductor light source, so that the light from the semiconductor light source(s) can pass through practically unhindered. Also, the cooling body may have further recesses e.g. for other components, solder points and/or for the passage of structural components such as legs etc. The recesses in general allow a direct contact of the cooling body, or with only a very small gap, and hence a particularly low heat resistance.

A further embodiment provides that the cooling body is a dish-like cooling body with a plate-like base and a side edged protruding at an angle therefrom, wherein the at least one recess for the at least one semiconductor light source is made in the base. Such a cooling body is particularly simple to produce.

In a further embodiment, the cooling body is attached to the substrate by means of an adhesive heat-conductive layer, in particular is glued thereto. This allows a fixed connection with only a very low heat resistance. The adhesive heat-conductive layer may e.g. be a TIM film (thermal interface material). The heat-conductive layer may also consist of a heat-conductive paste.

In a refinement, the cooling body lies on the front of the substrate via a gap filler with good thermal conductivity. In this way, no recesses are required in the base (e.g. for solder points) since the gap filler allows a greater distance to be set between the cooling body and the front of the substrate. The gap filler has a substantially higher thermal conductivity than conventional substrate materials. It may for example be made of a heat-conductive paste.

In a further embodiment, the substrate is accommodated in a housing. This provides protection from touch and protection from mechanical and chemical stresses.

The substrate may be fixed in the housing by force fit (e.g. by means of a press fit or a clamp fit), by form fit and/or by material fit (e.g. by means of adhesive). It may e.g. lie on retaining tabs present on the inside of the housing, or on a step of the housing.

The housing consists in particular of an electrically isolating material, in particular plastic. The housing may be formed in one piece or in several pieces.

The housing may in particular have a socket region on the back which, together with at least one electrical contact element, may form a socket of the semiconductor lamp. The socket may for example be an Edison socket or a bi-pin socket.

In a further embodiment, the housing is open on the front. This allows insertion of components of the semiconductor lamp. Also, a fitting direction is thus established which keeps production complexity to a low level.

In yet a further embodiment, the side edge of the cooling body lies superficially on an inside of the housing. This allows an effective heat dissipation and, via the housing, also a secure seat in the housing e.g. in a clamp fit. For this, the side edge may be inserted, e.g. clamped, in particular between retaining tabs and a rigid housing wall. The retaining tabs may carry the substrate on the top side. The side edge extends in particular to the rear. It may have one or more interruptions in order to provide elastic deformability.

In a further embodiment, the driver circuit in the housing is surrounded by potting compound. This improves a heat dissipation to the housing since potting compound has a lower heat resistance than air. Also, the driver circuit (and any wires leading therefrom, e.g. to the socket) can thus be particularly protected e.g. against mechanical stresses. The potting compound may for example be added after insertion of the equipped substrate in the housing. It is preferably filled at most to the height of the substrate, in order not to damage or cover the LED chips.

In a further embodiment, the substrate has a conductive structuring only on one side, and components attached to the other side of the substrate are electrically connected to the conductive structuring via electrically conductive passages through the substrate. Such a substrate is particularly economic. Alternatively, a substrate with a conductive structure on both sides may be used.

The electrically conductive passage may be an independent passage e.g. in the form of at least one through-contacting or at least one via (Vertical Interconnect Access). A conductive passage may be configured additionally or alternatively as a connecting pin of a component designed for push-through mounting (also known as "through-hole technology" or THT, or "pin-in-hole technology" or PIH), e.g. an electrical or electronic component of the driver circuit. The components of the driver circuit may thus in particular be THT components, the connection pins or connecting legs of which are guided for example through the substrate and electrically connected on the front, e.g. soldered there. Alternatively or additionally, for example, at least one component may be electrically connected on the back with a via, e.g. an SMD component may be soldered to a via.

In yet a further embodiment, at least one optical element is connected after the cooling body and has legs or feet protruding to the rear, which extend through a respective recess in the base of the cooling body as far as the substrate. In a simple fashion, the legs allow precise positioning of the optical element relative to the at least one semiconductor light source. They may e.g. serve as spacers. The recesses may serve as orientation aids and as lateral guides.

In a further embodiment, the semiconductor lamp is a retrofit lamp. This may be used instead of a conventional lamp without semiconductor light sources, and therefore in particular has a socket for connection to a conventional bulb fitting. The retrofit lamp may e.g. be an incandescent retrofit lamp, e.g. with an Edison socket, e.g. type E14 or E27. It may also be a halogen retrofit lamp, e.g. with a bi-pin socket e.g. type GU, e.g. GU10 or GU 5.3.

The properties, features and advantages described above of this invention and the manner in which these are achieved will become clearer and easier to understand in connection with the diagrammatic description below of an exemplary embodiment which is explained in more detail in connection with the drawings. For the sake of clarity, the same or equivalent elements carry the same reference numerals.

Figure 1:
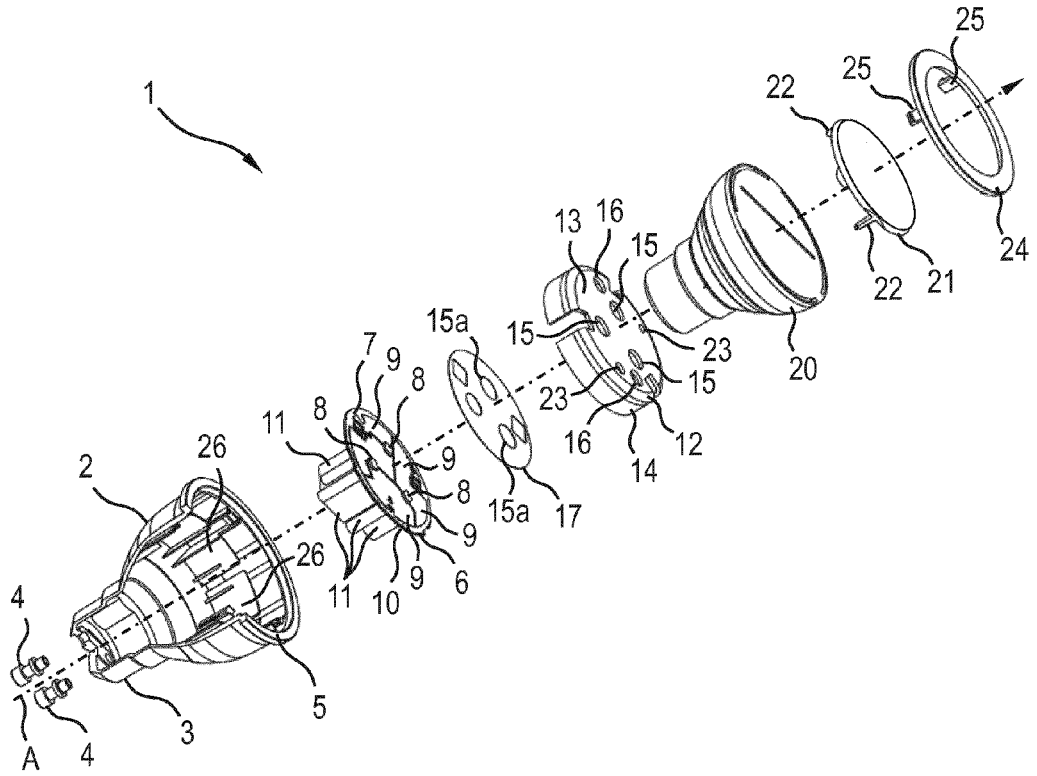
FIG. 1 shows, in an exploded depiction in an oblique view, a semiconductor lamp according to a first exemplary embodiment.

FIG. 1 shows, as an exploded depiction in an oblique view, a semiconductor lamp 1 in the form of a halogen retrofit lamp. The semiconductor lamp 1 has a housing 2 with a cup-like base form with a socket region 3 on its rear end. The housing 2 is here shown partially cut away. The semiconductor lamp 1 has a longitudinal axis A running from the back (the socket region 3) to the front (a light emission region).

The socket region 3 serves for mechanical fixing of semiconductor lamp 1 in a conventional bi-pin bulb fitting (not shown), e.g. for halogen lamps. For further mechanical fixing and the electrical connection of the semiconductor lamp 1, two metallic connecting pins 4 protrude to the rear from a rear face of the socket region 3, and together with the socket region 3 form a bi-pin socket of the semiconductor lamp 1, e.g. of the type "GU", e.g. GU10.

The housing 2 is open at the front, wherein a substrate 6 can be inserted through a front opening 5. The substrate 6 is here configured as a circular FR4 or CEM substrate as shown more precisely in FIG. 2. Several semiconductor light sources in the form of LED chips 8 are arranged on the front 7 of the substrate 6. The LED chips 8 are connected together via contact fields 9 present on the front 7. The contact fields 9 consist of metallic layers, e.g. of copper, and together form a conductive structure.

Components 11 of the driver circuit for controlling the LED chips 8 are attached to a back 10 of the substrate 6. The substrate 6 is thus a common substrate for both the LED chips 8 and for the components 11 of the driver circuit. The front 7 and the back 10 of the substrate 6 are in principle electrically isolated from each other. An electrical connection of the components 11 of the driver circuit and the LED chips 8 is achieved by at least one electrically conductive passage (not shown) between the front 7 and the back 10 of the substrate 6.

In a variant, the substrate 6 is provided with a respective conductive structure on both sides, each of which may have one or more conductor tracks and/or contact fields. The conductive structure here has four contact fields 9 which connect the LED chips 8, physically arranged in a ring, electrically in series. In a particularly economic variant, the substrate 6 has a conductive structure only on one side, e.g. here on the front 7. An electrical connection of the components 11 on the back 10 to the conductive structure on the front 7 may then be implemented e.g. by means of the conductive passage(s). This may e.g. be achieved in that the components 11 are components configured for through-hole mounting, for example in that they have connecting pins (not shown) guided through the substrate 6.

Figure 2:
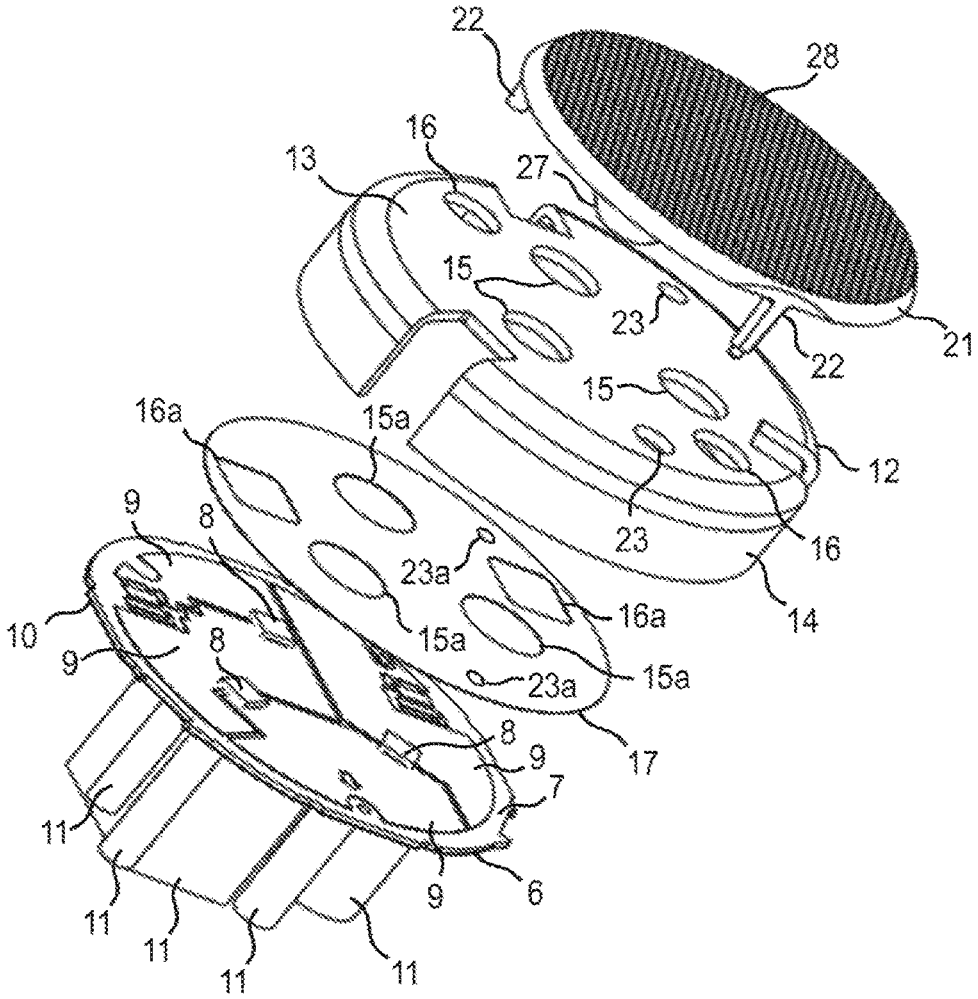
FIG. 2 shows, in an exploded depiction in an oblique view, selected parts of the semiconductor lamp according to the first exemplary embodiment.

A cooling body 12 with a dish-like base form lies superficially on the front 7 of the substrate 6, as shown more precisely in FIG. 2. The cooling body 12 has a plate-like base 13 and a side edge 14 extending from the rim to the rear, with multiple interruptions. The base 13 has recesses 15 for the LED chips 8 and further recesses 16, e.g. for the protrusions on the front 7 of the substrate 6 created by the conductive passages. Also, recesses 23 for legs 22 are present in the base 13, as will be explained in more detail below.

The cooling body 12 is glued to the substrate 6 by means of an adhesive heat-conductive layer 17. This ensures a strong fixing with simultaneously low thermal resistance. The heat-conductive layer 17 has holes or recesses 15*a*, 16*a* or 23*a* similar to the recesses 15, 16 and 23 of the base 13, as shown in more detail in FIG. 2. The heat-conductive layers 17 may e.g. be present as a heat-conduction film. As an alternative to a TIM material, a so-called gap filler may be used, e.g. a "gap pad", so that recesses 16*a* for protrusions caused by conductive passages may be omitted without overly increasing a heat resistance.

In order to improve a mechanical and thermal connection of the components 11 to the housing 2, the housing 2 is filled up to the substrate 6 with a potting compound 20, which also surrounds the components 11.

The cooling body 12 on the front is covered by an optical element in the form of a lens element 21. The lens element 21 is a common lens for the LED chips 8, and on the back has several (here three) protruding contact regions in the form of pin-like feet or legs 22, as shown in more detail in FIG. 2. The legs 22 lead through recesses 23 in the base 13 of the cooling body 12 and similar recesses 23*a* in the heat-conductive layer 17. They contact the front 7 of the substrate 6 and act as positioning aids, in particular as spacers.

The lens element 21 is pressed backward by means of a retaining ring 24 so that it does not detach from the substrate 6. For this, the retaining ring 24 is arranged in front of the lens element 21 and can engage with an inside of the housing 2 via catch hooks 25.

Figure 3:
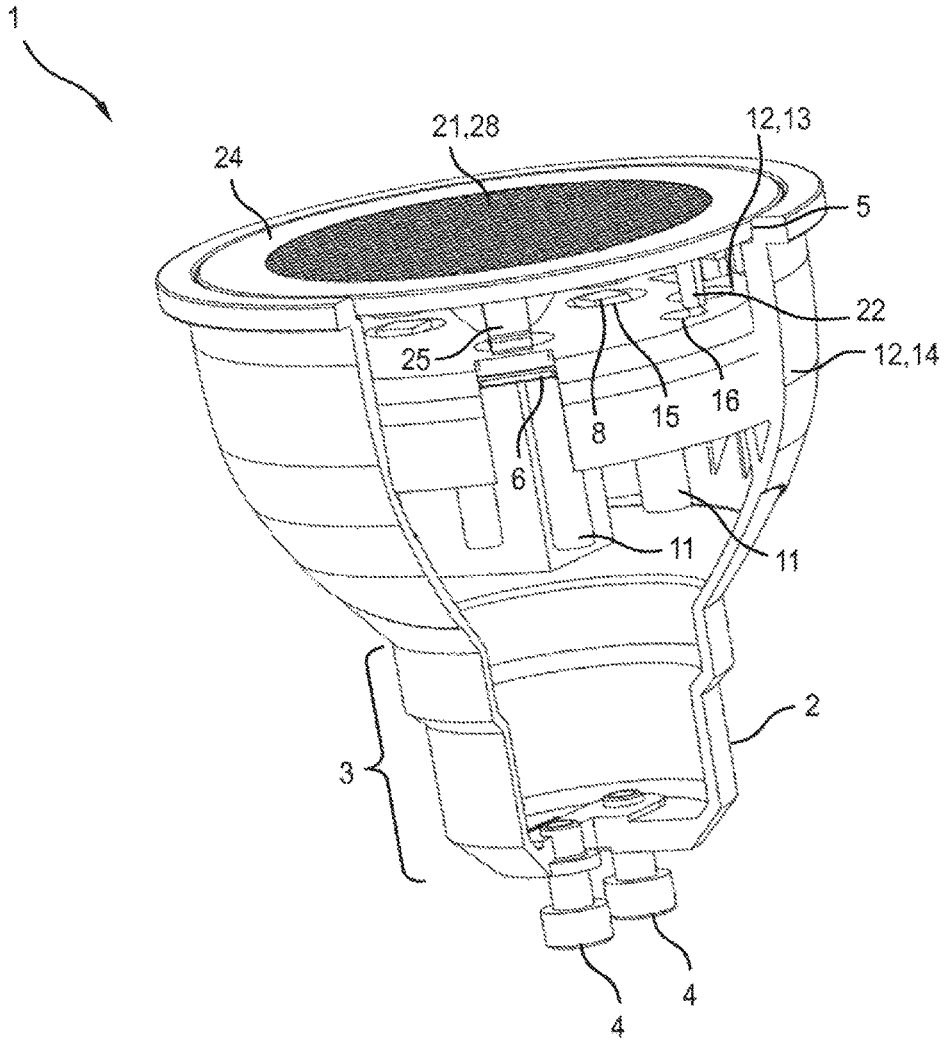
FIG. 3 shows, as a partial section depiction in an oblique view, the assembled semiconductor lamp according to the first exemplary embodiment.
Figure 4:
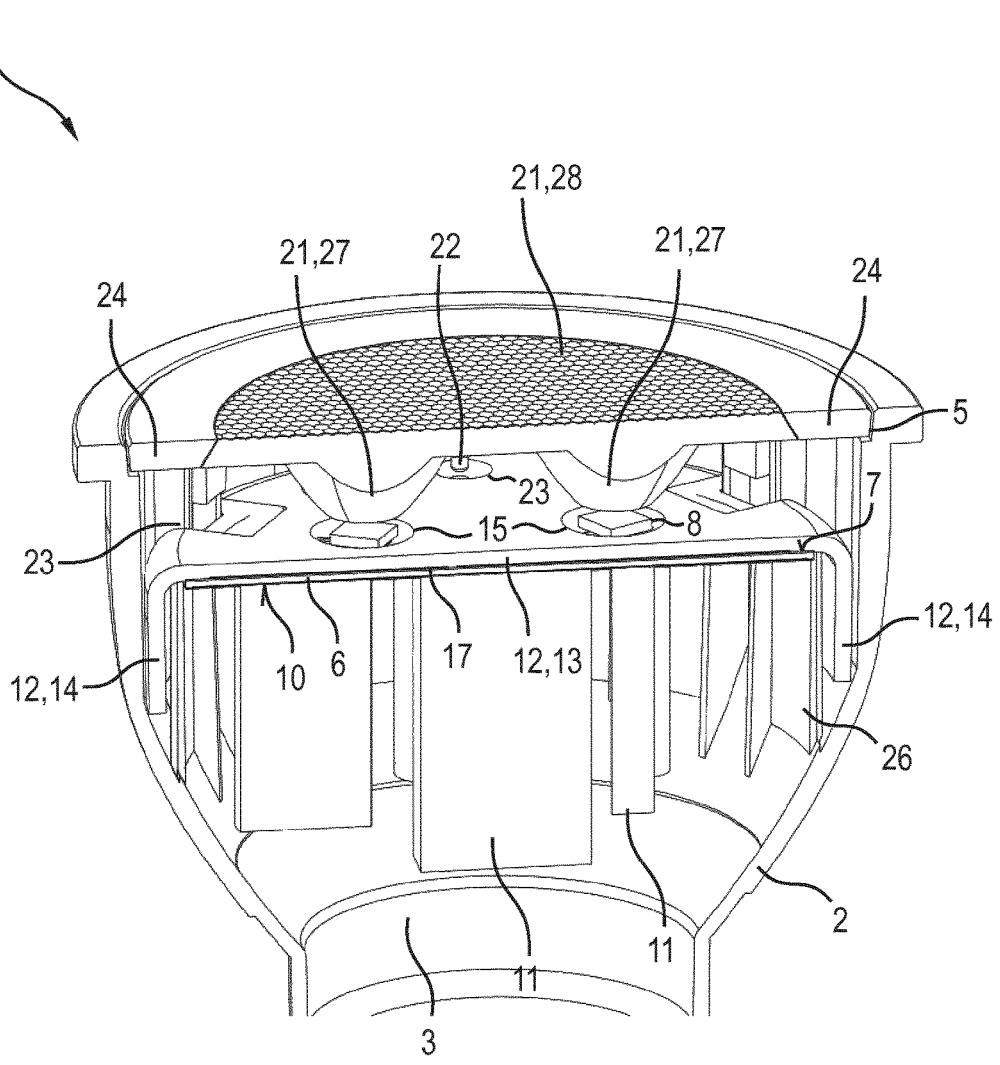
FIG. 4 shows, as a partial section depiction in an oblique view, an extract from the semiconductor lamp according to the first exemplary embodiment.

FIG. 3 shows the assembled semiconductor lamp 1 with a housing 2 cut away at the side. FIG. 4 shows the assembled semiconductor lamp 1 is a section view through a front region at the level of the substrate 6. The potting compound 20 is not shown on these two figures.

The side edge 14 of the cooling body 12 lies with its outside superficially on the housing 2 and thus allows an effective heat transmission to the housing 2. Also, the cooling body 12 may be held thus clamped in the housing 2.

The substrate 6 lies with an edge region of its back 10 on retaining tabs 26 which protrude forward from an inside of the housing 2.

The retaining ring 24 at the front terminates practically flush with the housing 2.

Above each LED chip 8, the lens element 21 has a rearward protruding, lens-like light collection region 27. The light collection region 27 may for example have a recess with a convex base above each respective LED chip 8. In this way, practically all the light emitted from an LED chip 8 is captured and conducted forward over a wide area in the lens element 21. On its generally flat front, the lens element 21 has a field 28 of micro-lenses which further even out the light emission. The micro-lenses may in particular be formed convex e.g. spherical, aspherical or pad-like.

This semiconductor lamp 1 has only one fitting direction, which keeps the production complexity of the entire platform at a low level.

On operation of the semiconductor lamp 1, the driver circuit with the driver components 11 is supplied with an electrical power signal (e.g. a network voltage) via the electrical connection pins 4. The driver circuit converts the electrical power signal into an electrical operating signal suitable for operation of the series-connected LED chips 8. This may e.g. be cyclic and/or adjustable in relation to its current intensity. The operating signal may allow a dimmed operation of the LED chips 8. Since at least some of the connecting pins of the driver components 11 of the driver circuit are guided through the substrate 6 and electrically connected to the contact fields 9 present there, the operating signal may simply be supplied to the LED chips 8. The light then emitted by the LED chips 8 passes through the recesses 15 of the base 13 of the cooling body 12 and into the respective light collection regions 27 of the lens element 21. The light coupled into the rear of the lens element 21 is then emitted from the semiconductor lamp 1 at the front through the field 28 of micro-lenses. Waste heat generated by the LED chips 8 is transmitted to the base 13 of the cooling body 12 and then above all from its side edge 14 to the housing 2 and emitted outward through the housing 2.

Although the invention has been illustrated in detail and described with reference to the exemplary embodiment shown, the invention is not restricted thereto and other variations may be derived by the person skilled in the art without leaving the scope of protection of the invention.

In general, the terms "one" or "a" etc. mean an individual or a plurality, in particular in the sense of "at least one" or "one or more" etc., as long as this is not explicitly excluded e.g. by the expression "precisely one" etc.

Also, a figure given may mean precisely the given figure and also include a usual tolerance range, as long as this is not explicitly excluded.

REFERENCE NUMERALS

1 Semiconductor lamp
2 Housing
3 Socket region
4 Connecting pin
5 Front opening
6 Substrate
7 Front
8 LED chip
9 Contact field
10 Back
11 Component
12 Cooling body
13 Base
14 Side edge
15 Recess
15*a* Recess
16 Recess
16*a* Recess
17 Heat-conductive layer
20 Potting compound
21 Lens element
22 Leg
23 Recess
23*a* Recess
24 Retaining ring
25 Catch hook
26 Retaining tab
27 Light collection region
28 Field of micro-lenses
A Longitudinal axis

The invention claimed is:

1. A semiconductor lamp, comprising:

at least one semiconductor light source arranged on a front side of a substrate;

a driver circuit for controlling the at least one semiconductor light source, wherein at least part of the driver circuit is attached to a back side of the substrate facing away from the at least one semiconductor light source;

a cooling body lying superficially on the front side of the substrate, wherein the cooling body has at least one recess for the at least one semiconductor light source, and wherein the cooling body is a dish-like cooling body with a plate-like base and a side edge protruding therefrom at an angle; and at least one optical element disposed over the cooling body and having legs protruding to a rear, wherein each leg extends through a respective recess in the plate-like base of the cooling body as far as the substrate such that material of the cooling body physically intervenes between the legs and the at least one semiconductor light source.

2. The semiconductor lamp according to claim 1, wherein the at least one recess for the at least one semiconductor light source is made in the plate-like base.

3. The semiconductor lamp according to claim 1, wherein the cooling body is attached to the substrate by means of an adhesive heat-conductive layer.

4. The semiconductor lamp according to claim 1, wherein the substrate is accommodated in a housing.

5. The semiconductor lamp according to claim 4, wherein the housing has a socket region on a back of the housing and is open at a front of the housing.

6. The semiconductor lamp according to claim 4, wherein the side edge of the cooling body lies superficially on an inside of the housing.

7. The semiconductor lamp according to claim 4, wherein the driver circuit in the housing is surrounded by potting compound.

8. The semiconductor lamp according to claim 1, wherein the substrate has a conductive structuring on one side only, and components attached on the other side of the substrate are electrically connected to the conductive structuring via electrically conductive passages through the substrate.

9. The semiconductor lamp according to claim 1, wherein the semiconductor lamp is a retrofit lamp.

10. The semiconductor lamp according to claim 1, wherein the plate-like base of the cooling body has different recesses for the at least one semiconductor light source and for the legs protruding to the rear.

11. The semiconductor lamp according to claim 1, wherein the at least one recess for the at least one semiconductor light source and the recesses in the plate-like base of the cooling body through which each leg extends are coplanar.

12. The semiconductor lamp according to claim 1, wherein the cooling body further has at least one recess for protrusions on the front side of the substrate from conductive passages.

13. The semiconductor lamp according to claim 12, wherein material of the cooling body physically intervenes between the protrusions on the front side of the substrate from conductive passages and the at least one semiconductor light source.

14. The semiconductor lamp according to claim 12, wherein the at least one recess for the at least one semiconductor light source and the at least one recess for protrusions on the front side of the substrate from conductive passages are co-planar.

15. The semiconductor lamp according to claim 1, wherein only the legs of the at least one optical element are disposed within the cooling body.

16. The semiconductor lamp according to claim 15, wherein a main body portion of the at least one optical element is external to the cooling body.

17. The semiconductor lamp according to claim 16, wherein the main body portion of the at least one optical element is not in physical contact with the cooling body.

18. The semiconductor lamp according to claim 1, wherein the at least one optical element is further configured to reside on a shoulder of a housing of the semiconductor lamp.

19. The semiconductor lamp according to claim 1, wherein the cooling body is adhered to the front side of the substrate.

20. The semiconductor lamp according to claim 1, wherein the at least one optical element is disposed over of the cooling body such that an air gap separates a rear side of the at least one optical element and a front side of the cooling body.

* * * * *